US007311021B2

(12) United States Patent
Macor

(10) Patent No.: US 7,311,021 B2
(45) **Date of Patent: *Dec. 25, 2007**

(54) WRENCH ENGAGEMENT TECHNOLOGIES

(75) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/504,153

(22) Filed: Aug. 15, 2006

(65) Prior Publication Data

US 2006/0272457 A1 Dec. 7, 2006

Related U.S. Application Data

(63) Continuation-in-part of application No. 11/372,784, filed on Mar. 10, 2006, now Pat. No. 7,159,492, which is a continuation-in-part of application No. 11/050,949, filed on Feb. 4, 2005, now abandoned.

(51) Int. Cl.
*B25B 13/06* (2006.01)

(52) U.S. Cl. ..... 81/121.1; 81/124.3

(58) Field of Classification Search ..... 81/119, 81/121.1, 124.3, 124.6, 124.5
See application file for complete search history.

(56) References Cited

U.S. PATENT DOCUMENTS

| | | | | |
|---|---|---|---|---|
| 3,354,757 | A * | 11/1967 | Grimm et al. | 81/124.3 |
| 5,388,486 | A * | 2/1995 | Ruzicka et al. | 81/124.3 |
| D465,707 | S * | 11/2002 | Chen | D8/28 |
| 2005/0034570 | A1 * | 2/2005 | Hsien | 81/124.6 |

* cited by examiner

*Primary Examiner*—Hadi Shakeri

(57) ABSTRACT

A wrench tool is described which comprises an orifice configured to control the rotation of a hexagonal work piece. The orifice is substantially cylindrical and comprises an array of only eighteen principle longitudinal grooves positioned therein substantially forming a symmetrical pattern around an imaginary central axis. The eighteen grooves are formed and spaced apart so as to create an array of only eighteen principle longitudinal protuberances. The protuberances substantially form a symmetrical pattern around the imaginary central axis for engagement with the hexagonal work piece. Each protuberance is formed having at least two engaging surfaces positioned together in at least partial alignment with a predetermined engaging angle. The engaging surfaces may be flat, arcuate, or a combination thereof.

15 Claims, 4 Drawing Sheets

WRENCH ENGAGEMENT TECHNOLOGIES

REFERENCES TO RELATED APPLICATIONS

This application relates to, and is a continuation-in-part of U.S. patent application Ser. No. 11/372,784 filed on Mar. 10, 2006 entitled "Wrench engagement technologies" now U.S. Pat. No. 7,159,492, which is a continuation-in-part of patent application Ser. No. 11/050,949 filed on Feb. 4, 2005 entitled "Wrench engagement technologies" now abandoned, all of which have been filed by the inventor herein.

FIELD OF THE INVENTION

The present invention relates to hand tools, particularly hand operated wrenches, and more particularly box type wrenches and wrench sockets.

BACKGROUND OF THE INVENTION

Hand operated wrenches have been around for many years and most are designed to control the rotation of nuts, bolts and various fasteners. These wrenches usually have either a six or twelve point socket opening for turning the fasteners. It is believed by some that the six point design can apply more torque to a fastener then the twelve point design without "rounding" the fastener. On the other hand, the twelve point design is desirable because it requires less re-engagement swing arc than the six point design. The language of "re-engagement swing arc" shall be defined herein as the least amount of swing arc required (measured in degrees) for a wrench to re-engage a work piece such as a fastener that is being tightened or loosened. The minimum re-engagement swing arc of a twelve point wrench design is thirty degrees, or half of the minimum re-engagement swing arc of a six point design which is sixty degrees. Applicant contemplates an improved wrench that will require less re-engagement swing arc than each of the prior art, six and twelve point wrench designs, while maintaining reasonable, if not substantial wrench strength to maximize the application of torque to a work piece such as a fastener, while minimizing fastener deformation and wrench breakage.

SUMMARY OF THE INVENTION

A wrench tool is described which comprises an orifice configured to control the rotation of a hexagonal work piece. The orifice is substantially cylindrical and comprises an array of only eighteen principle longitudinal grooves positioned therein substantially forming a symmetrical pattern around an imaginary central axis. The eighteen grooves are formed and spaced apart so as to create an array of only eighteen principle longitudinal protuberances. The protuberances substantially form a symmetrical pattern around the imaginary central axis for engagement with the hexagonal work piece. Each protuberance is formed having at least two engaging surfaces positioned together in at least partial alignment with a predetermined engaging angle. The at least two engaging surfaces may be flat, arcuate, or a combination thereof.

With regards to the present invention above, applicant considers the following objectives:

It is an important objective of the present invention that it requires less re-engagement swing arc than each of the prior art, six and twelve point wrench designs.

It is another important objective of the present invention that it provide a user with better accessibility to fasteners than each of the prior art, six and twelve point wrench designs, especially in limited access environments.

It is another important objective of the present invention that it provide better synchronization and initial engagement with a work piece such as a fastener, than each of the prior art, six and twelve point wrench designs.

It is another important objective of the present invention that it achieves reasonable, if not substantial wrench strength to maximize the application of torque to a work piece such as a fastener, while minimizing fastener deformation and wrench breakage.

And, it is yet another important objective of the present invention that it be cost efficient to manufacture and commercially viable.

DETAILED DESCRIPTION OF THE DRAWINGS

The various drawings provided herein are for the purpose of illustrating possible embodiments of the present invention and not for the purpose of limiting same. Therefore, the drawings herein represent only a few of the many possible variations of the present invention.

Figure 1:
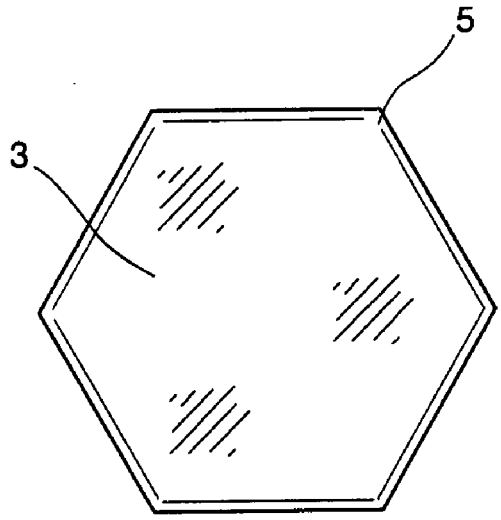
FIG. 1 shows a top plan view of a hexagonal work piece such as a bolt head; and, FIG. 2 shows a top plan cut view of a box type wrench having a wrench head comprising an embodiment of the present invention wrench engagement technologies; and, FIG. 3 shows a large fragmentary view of one of many possible examples of a present invention protuberance; and, FIG. 4 shows a large fragmentary view of one of many possible examples of a present invention protuberance; and, FIG. 5 shows a large fragmentary view of one of many possible examples of a present invention protuberance; and, FIG. 6 shows a large fragmentary view of one of many possible examples of a present invention protuberance; and, FIG. 7 shows a top plan cut view of a box type wrench having a wrench head comprising an embodiment of the present invention wrench engagement technologies; and, FIG. 8 shows a top plan view of a wrench socket comprising another embodiment of the present invention wrench engagement technologies.

FIG. 1 shows a top plan view of a hexagonal work piece such as a bolt head. Hexagonal work piece 3 has six points represented by point 5. The present invention wrench engagement technologies are generally designed to function best with hexagonal fasteners such as nuts, bolts, hexagonal screws etc.

Figure 2:
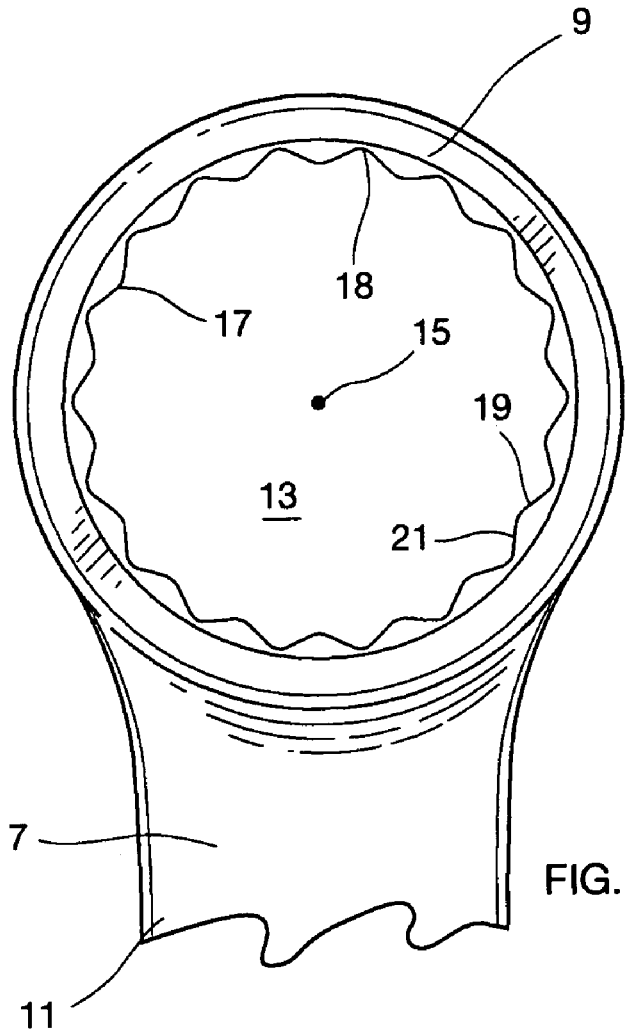

FIG. 2 shows a top plan cut view of a box type wrench having a wrench head comprising an embodiment of the present invention wrench engagement technologies. Wrench tool 7 has a wrench head 9, and handle 11, and an orifice 13 configured to control the rotation of a hexagonal work piece such as that shown in FIG. 1. Orifice 13 is substantially cylindrical and comprises an array of only eighteen principle longitudinal grooves positioned therein substantially forming a symmetrical pattern around an imaginary central axis 15. Groove 18 is representative of such grooves. The eighteen grooves are formed and spaced apart so as to create an array of only eighteen principle longitudinal protuberances. Protuberance 17 is representative of such protuberances. The protuberances form a symmetrical pattern around the imaginary central axis 15 as shown for engagement with a work piece, such as that shown in FIG. 1. The present invention is designed to function best with only eighteen longitudinal grooves and only eighteen longitudinal protuberances. Each protuberance is formed having at least two engaging surfaces such as 19 and 21 positioned together in at least partial alignment with a predetermined engaging angle which is not defined in this Figure.

Figure 3:
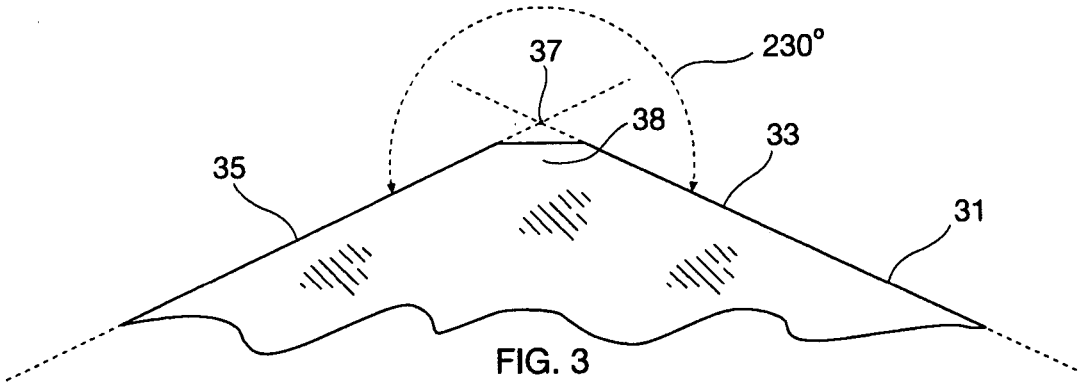

FIG. 3 shows a large fragmentary view of one of many possible examples of a present invention protuberance. For example, each of the eighteen protuberances of the wrench tool shown in FIG. 2 could be formed as shown here in FIG. 3. Protuberance 31 has at least two engaging surfaces 33 and 35 which are positioned together in at least partial alignment with a predetermined engaging angle which is, in this example, 230 degrees with an engaging angle point 37 as shown. Protuberance 31 has a tip 38 which does not fully extend to the point 37 of the predetermined engaging angle of 230 degrees as shown. Accordingly, engaging surfaces 33 and 35 do not completely align with the entire engaging angle, but when positioned together they are in at least partial, if not substantial alignment with the predetermined engaging angle as shown.

Figure 4:
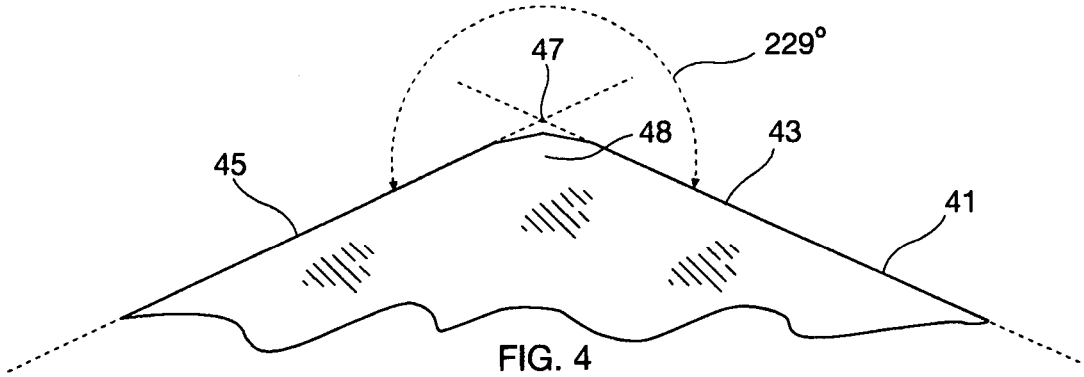

FIG. 4 shows a large fragmentary view of another possible example of a present invention protuberance. For example, each of the eighteen protuberances of the wrench tool shown in FIG. 2 could be formed as shown here in FIG. 4. Protuberance 41 has at least two engaging surfaces 43 and 45 which are positioned together in at least partial alignment with a predetermined engaging angle which is, in this example, 229 degrees with an engaging angle point 47 as shown. Protuberance 41 has a tip 48 which does not fully extend to the point 47 of the predetermined engaging angle of 229 degrees as shown. Accordingly, engaging surfaces 43 and 45 do not completely align with the entire engaging angle, but when positioned together they are in at least partial, if not substantial alignment with the predetermined engaging angle as shown.

Figure 5:
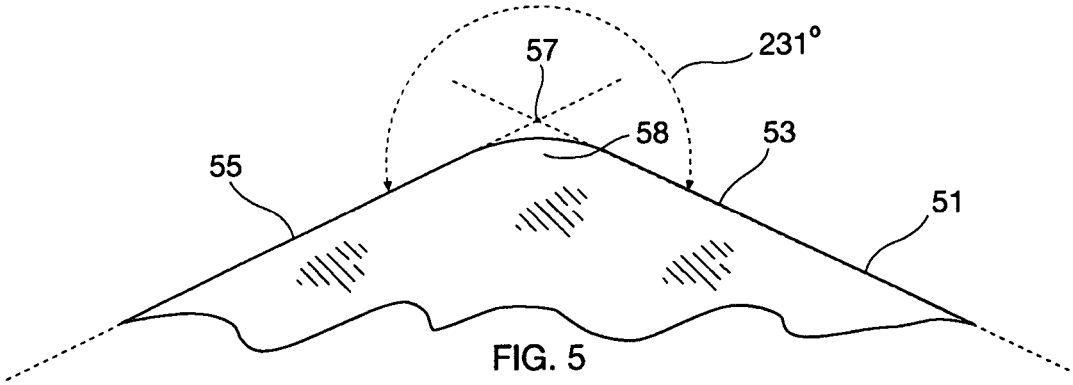

FIG. 5 shows a large fragmentary view of another possible example of a present invention protuberance. For example, each of the eighteen protuberances of the wrench tool shown in FIG. 2 could be formed as shown here in FIG. 5. Protuberance 51 has at least two engaging surfaces 53 and 55 which are positioned together in at least partial alignment with a predetermined engaging angle which is, in this example, 231 degrees with an engaging angle point 57 as shown. Protuberance 51 has a tip 58 which does not fully extend to the point 57 of the predetermined engaging angle of 231 degrees as shown. Accordingly, engaging surfaces 53 and 55 do not completely align with the entire engaging angle, but when positioned together they are in at least partial, if not substantial alignment with the predetermined engaging angle as shown.

Figure 6:
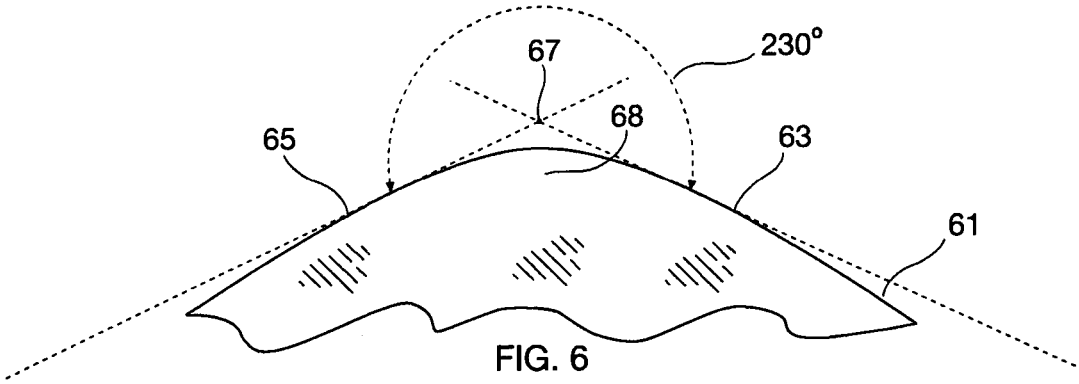

FIG. 6 shows a large fragmentary view of one of many possible examples of a present invention protuberance. For example, each of the eighteen protuberances of the wrench tool shown in FIG. 2 could be formed as shown here in FIG. 6. Protuberance 61 has at least two engaging surfaces 63 and 65 which are positioned together in at least partial alignment with a predetermined engaging angle which is, in this example, 230 degrees with engaging angle point 67 as shown. Protuberance 61 has a tip 68 which does not fully extend to the point 67 of the predetermined engaging angle of 230 degrees as shown. In this embodiment shown, the at least two engaging surfaces 63 and 65 are each substantially arcuate and positioned tangent to the predetermined engaging angle of 230 degrees as shown. Accordingly, engaging surfaces 63 and 65 do not completely align with the entire engaging angle, but when positioned together must be in at least partial alignment with, or tangent to, the predetermined engaging angle as shown.

Therefore when referring to FIGS. 2, 3, 4, 5, and 6 together, the engaging surfaces of the present invention may be substantially flat, substantially arcuate, or multi-faceted to achieve off-corner loading and force distribution between wrench and work piece. Off-corner loading and force distribution will maximize the application of torque to a work piece while minimizing deformation of the work piece and wrench breakage.

Figure 7:
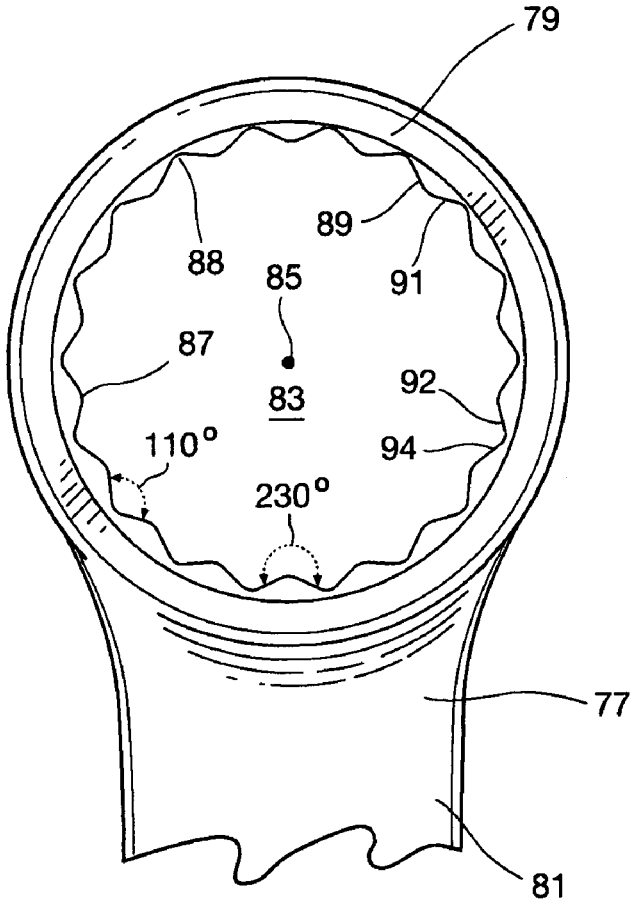

FIG. 7 shows a top plan cut view of a box type wrench having a wrench head comprising an embodiment of the present invention wrench engagement technologies. Wrench tool 77 has a wrench head 79, and handle 81, and an orifice 83 configured to control the rotation of a hexagonal work piece such as a nut, bolt etc. Orifice 83 is substantially cylindrical and comprises an array of only eighteen principle longitudinal grooves positioned therein substantially forming a symmetrical pattern around an imaginary central axis 85. Groove 88 is representative of such grooves. The eighteen grooves are formed and spaced apart so as to create an array of only eighteen principle longitudinal protuberances. Protuberance 87 is representative of such protuberances. The protuberances form a symmetrical pattern around the imaginary central axis 85 as shown for engagement with a work piece, such as that shown in FIG. 1. The present invention is designed to function best with only eighteen longitudinal grooves and only eighteen longitudinal protuberances. In this embodiment of the present invention, each protuberance is formed having at least two engaging surfaces such as 89 and 91 positioned together in at least partial alignment with a predetermined engaging angle preferably in the range of 223 through 237 degrees inclusive; and, more preferably in the range of 226 through 234 degrees inclusive such as 230 degrees as shown. Such a configuration provides off-corner loading and force distribution between wrench and work piece. Off-corner loading and force distribution will maximize the application of torque to a work piece while minimizing deformation of the work piece and wrench breakage. In the event that the engaging surfaces are curved or arcuate, the engaging surfaces are simply positioned tangent to the aforementioned preferred engaging angles. And, each protuberance could be formed the same as, or similar to, any of the examples shown in FIGS. 3, 4, 5 and 6, so that the tip of each protuberance does not fully extend to the point of the predetermined engaging angle as more fully described in FIGS. 3, 4, 5, and 6. Therefore, engaging surfaces 89 and 91 need not fully align with the entire engaging angle, but when positioned together must be in at least partial alignment with, or tangent to, the predetermined engaging angle.

Another possible characteristic of the present invention is that each of the eighteen grooves may have at least two engaging surfaces such as those represented by engaging surfaces 92 and 94 (one engaging surface from each of two adjacent protuberances) which are positioned together in at least partial alignment with a predetermined groove engaging angle This groove engaging angle is preferably in the range of 100 through 120 degrees inclusive; and, more preferably in the range of 103 through 117 degrees inclusive, such as 110 degrees as shown.

Figure 8:
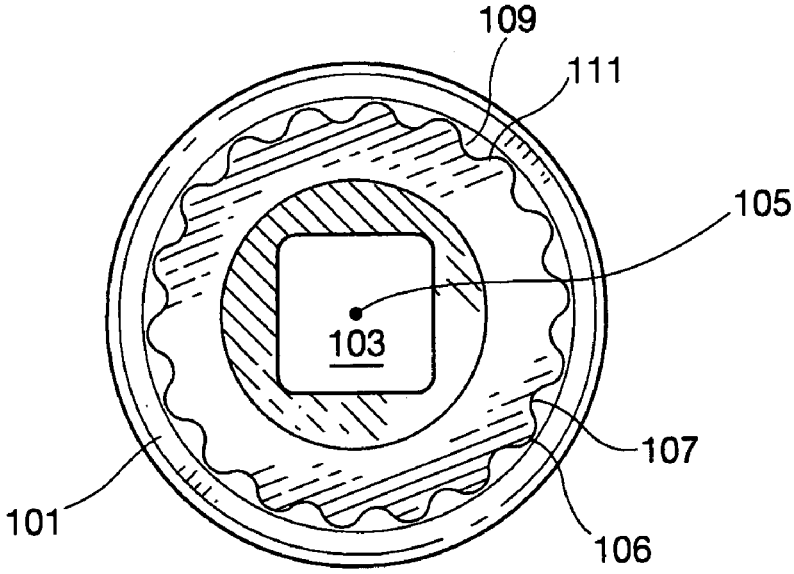
Figure 9:
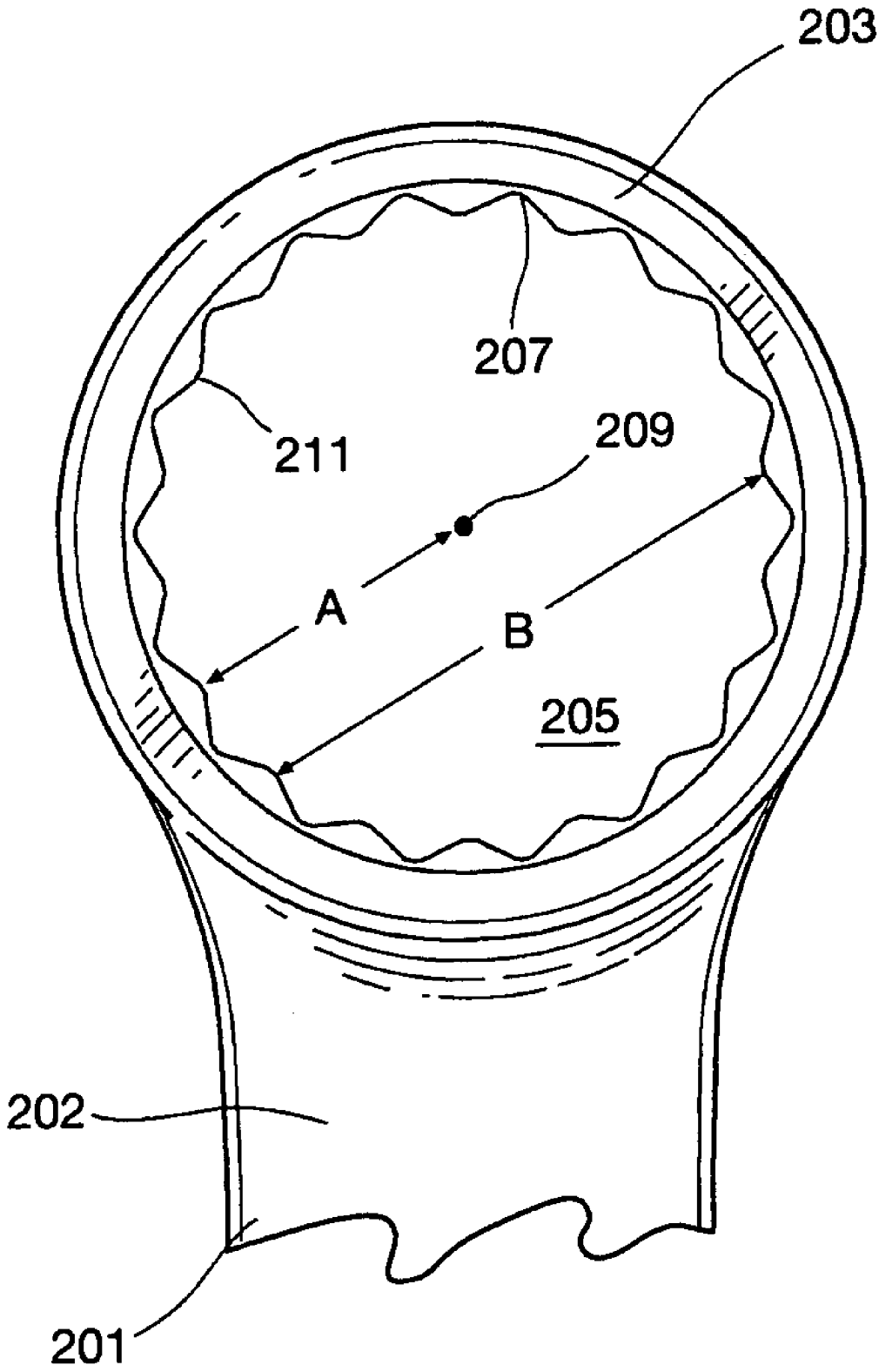
FIG. 9 shows a top plan cut view of a box type wrench having a wrench head comprising another embodiment of the present invention wrench engagement technologies.

FIG. 8 shows a top plan view of a wrench socket comprising another embodiment of the present invention wrench engagement technologies. Wrench socket 101 is shown comprising an orifice 103 which is substantially cylindrical and comprises an array of only eighteen principle longitudinal grooves positioned therein forming a symmetrical pattern around an imaginary central axis 105. Groove 106 is one of the eighteen grooves and is representative of such. The eighteen grooves are formed and spaced apart so as to create an array of only eighteen principle longitudinal protuberances. Protuberance 107 is one of the eighteen protuberances and is representative of such. The present invention is designed to function best with only eighteen longitudinal grooves and only eighteen longitudinal protuberances. The protuberances form a symmetrical pattern around the imaginary central axis 105 for engagement with a work piece, such as hexagonal work piece 3 shown in FIG. 1. Each of the eighteen protuberances has at least two engaging surfaces such as engaging surfaces 109 and 111 which are substantially arcuate convex. In this embodiment of the present invention, each protuberance is formed similar to the protuberance described and shown in FIG. 6. FIG. 9 shows a top plan cut view of a box type wrench 201 comprising another embodiment of the present invention wrench engagement technologies. Wrench 201 comprises a handle 202 and wrench head 203 which comprises an orifice 205 which has a predetermined geometry for controlling the rotation of a hexagonal work piece. Orifice 205 is substantially cylindrical and comprises an array of eighteen longitudinal grooves therein with groove 207 representative of such grooves. The eighteen grooves substantially form a symmetrical pattern around an imaginary central axis 209. The eighteen grooves are formed and spaced apart so as to create an array of only eighteen longitudinal protuberances with protuberance 211 representative of such protuberances. The protuberances also substantially form a symmetrical pattern around imaginary central axis 209 for engagement with a work piece such as work piece 3 shown in FIG. 1. The protuberances are positioned apart relative to each other and to the imaginary central axis 109 by predetermined dimensions whereas the least distance (or shortest measurable dimension) between imaginary central axis 209 and each of the protuberances is a predetermined Dimension A as shown, and, the least distance (or shortest measurable dimension) between any eight adjacent protuberances is a predetermined Dimension B as shown. In this embodiment of the present invention, Dimension A is preferably equal to or greater than 52% of Dimension B and equal to or less than 55% of Dimension B; and more preferably, Dimension A is equal to or greater than 52.5% of Dimension B and equal to or less than 54.5% of Dimension B; and most preferably, Dimension A is equal to or greater than 53% of Dimension B and equal to or less than 54% of Dimension B. This predetermined geometry and dimensional relationship provides optimum off-corner loading and force distribution between wrench and work piece, while maintaining the proper amount of free play between wrench and work piece.

Each of the novel "eighteen point" design configurations of the present invention described above require significantly less re-engagement swing arc than each of the prior art, six and twelve point wrench designs. Again, the language of "re-engagement swing arc" is defined herein as the least amount of swing arc required (measured in degrees) for a wrench to re-engage a work piece such as a fastener that is being tightened or loosened. The minimum re-engagement swing arc of the present invention is just 20 degrees, while the prior art six and twelve point designs require 60 degrees and 30 degrees respectively. Accordingly, the next best prior art wrench design (12 points) requires an additional 50% more re-engagement swing arc than the present invention. And, the prior art six point design requires an additional 200% more re-engagement swing arc than the present invention. Therefore, the present invention described above provides superior accessibility to fasteners, especially in limited access environments. Another benefit of the present invention described above is that it requires less time and effort to synchronize the wrench orifice onto a work piece during the initial engagement process, because synchronization requires less rotation of the wrench head than either the aforementioned prior art wrench designs.

It is believed that the present invention wrench engagement technologies will have many applications to different wrenches, including but not limited to box wrenches, double-box wrenches, combination wrenches and wrench sockets of all lengths. When considering the present invention, simplicity and obviousness should not be confused or considered the same. Accordingly, the novelty and complexity of the present invention must be measured by its structure resulting from the many interrelated objectives set forth herein, including wrench to fastener accessibility in normal and limited access environments, wrench to fastener synchronization (initial engagement), wrench strength, wrench torque capacity, deformation of the work piece, manufacturability, and commercial viability.

Although illustrative embodiments have been described herein in detail, it should be noted and will be appreciated by those skilled in the art that numerous variations may be made within the scope of this invention without departing from the principles and chief advantages of this invention. Unless otherwise specifically stated, the terms and expressions have been used herein as terms of description and not limitation. There is no intention to use the terms or expressions to exclude any equivalents of features shown and described or portions thereof, and this invention should be defined in accordance with the claims that follow, or the equivalence thereof.

Having thus described the invention, the following is claimed:

1. A wrench tool comprising an orifice having a predetermined geometry for controlling the rotation of a hexagonal work piece, said orifice being substantially cylindrical and comprising an array of only eighteen longitudinal grooves positioned therein substantially forming a symmetrical pattern around an imaginary central axis, said eighteen grooves being formed and spaced apart so as to create an array of only eighteen longitudinal protuberances, said protuberances substantially forming a symmetrical pattern around said imaginary central axis for engagement with said work piece, each said groove further being formed having at least two engaging surfaces substantially forming an inner engaging angle within the range of 103 through 117 degrees inclusive, said protuberances being positioned apart relative to each other and to said imaginary central axis by predetermined dimensions whereas the least distance between said imaginary central axis and each said protuberance being a predetermined Dimension A, and the least distance between any eight adjacent protuberances being a predetermined Dimension B, and, Dimension A being substantially equal to or greater than 52% of Dimension B and substantially equal to or less than 55% of Dimension B.

2. A wrench tool of claim 1, wherein said wrench tool is a wrench socket.

3. A wrench tool of claim 1, wherein said wrench tool comprises a box type wrench head.

4. A wrench tool of claim 1, wherein said at least two engaging surfaces are each substantially flat.

5. A wrench tool of claim 1, wherein said at least two engaging surfaces of each said groove are each substantially arcuate and positioned tangent to said predetermined engaging angle within the range of 103 through 117 degrees inclusive.

6. A wrench tool comprising an orifice having a predetermined geometry for controlling the rotation of a hexagonal work piece, said orifice being substantially cylindrical and comprising an array of only eighteen longitudinal grooves positioned therein substantially forming a symmetrical pattern around an imaginary central axis, said eighteen grooves being formed and spaced apart so as to create an array of only eighteen longitudinal protuberances, said protuberances substantially forming a symmetrical pattern around said imaginary central axis for engagement with said work piece, each said protuberance further being formed having at least two engaging surfaces substantially forming an outer engaging angle within the range of 223 through 237 degrees inclusive, said protuberances being positioned apart relative to each other and to said imaginary central axis by predetermined dimensions whereas the least distance between said imaginary central axis and each said protuberance being a predetermined Dimension A, and the least distance between any eight adjacent protuberances being a predetermined Dimension B, and, Dimension A being substantially equal to or greater than 52% of Dimension B and substantially equal to or less than 55% of Dimension B, each said outer engaging angle having an apex, and, each said protuberance having a tip not fully extending to the apex of the outer engaging angle formed by said two engaging surfaces.

7. A wrench tool of claim 6, wherein said wrench tool is a wrench socket.

8. A wrench tool of claim 6, wherein said wrench tool comprises a box type wrench head.

9. A wrench tool of claim 6, wherein said at least two engaging surfaces are each substantially flat.

10. A wrench tool of claim 6, wherein said at least two engaging surfaces are each substantially arcuate and positioned tangent to said predetermined engaging angle within the range of 223 through 237 degrees inclusive.

11. A wrench tool comprising an orifice having a predetermined geometry for controlling the rotation of a hexagonal work piece, said orifice being substantially cylindrical and comprising an array of only eighteen longitudinal grooves positioned therein substantially forming a symmetrical pattern around an imaginary central axis, said eighteen grooves being formed and spaced apart so as to create an array of only eighteen longitudinal protuberances, said protuberances substantially forming a symmetrical pattern around said imaginary central axis for engagement with said work piece, each said groove further being formed having at least two engaging surfaces substantially forming an inner engaging angle within the range of 103 through 117 degrees inclusive, each said protuberance further being formed having at least two engaging surfaces substantially forming an outer engaging angle within the range of 223 through 237 degrees inclusive, said protuberances being positioned apart relative to each other and to said imaginary central axis by predetermined dimensions whereas the least distance between said imaginary central axis and each said protuberance being a predetermined Dimension A, and the least distance between any eight adjacent protuberances being a predetermined Dimension B, and, Dimension A being substantially equal to or greater than 52% of Dimension B and substantially equal to or less than 55% of Dimension B.

12. A wrench tool of claim 11, wherein said wrench tool is a wrench socket.

13. A wrench tool of claim 11, wherein said wrench tool comprises a box type wrench head.

14. A wrench tool of claim 11, wherein said at least two engaging surfaces of each said protuberance are each substantially flat.

15. A wrench tool of claim 11, wherein said at least two engaging surfaces of each said protuberance are each substantially arcuate and positioned tangent to said predetermined engaging angle within the range of 223 through 237 degrees inclusive.

* * * * *